US009427030B2

(12) United States Patent
Buescher

(10) Patent No.: US 9,427,030 B2
(45) **Date of Patent: *Aug. 30, 2016**

(54) BRASSIERE ACCESSORY

(71) Applicant: Tracy Buescher, New York, NY (US)

(72) Inventor: Tracy Buescher, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/049,167

(22) Filed: Feb. 22, 2016

(65) Prior Publication Data

US 2016/0165963 A1 Jun. 16, 2016

Related U.S. Application Data

(63) Continuation-in-part of application No. 14/166,026, filed on Jan. 28, 2014.

(51) Int. Cl.
*A41C 3/12* (2006.01)
*A41D 27/08* (2006.01)

(52) U.S. Cl.
CPC ..... *A41C 3/12* (2013.01); *A41D 27/08* (2013.01)

(58) Field of Classification Search
CPC ..... A41C 3/00; A41C 3/02; A41C 3/12; A41F 3/00; A41F 1/006; A41F 17/00
USPC ..... 450/85–87; 2/326, 336, 311, 312, 325, 2/338
See application file for complete search history.

(56) References Cited

U.S. PATENT DOCUMENTS 1,849,321 A 3/1932 Tomlinson
5,820,443 A 10/1998 Burr
6,006,364 A * 12/1999 Newsom ..... A61F 15/02 2/323
6,120,007 A * 9/2000 Grant ..... F02M 9/14 261/23.2
6,135,853 A * 10/2000 Hopson ..... A41F 15/02 2/323
6,698,030 B2 * 3/2004 Cutler ..... A41F 15/007 2/267
6,857,936 B2 * 2/2005 Jones ..... A41F 15/002 450/86
6,872,119 B2 * 3/2005 Brink ..... A23G 3/563 2/244
7,278,900 B1 * 10/2007 Ostaseski ..... A41F 15/02 2/336
7,780,502 B2 * 8/2010 Calamari ..... A41B 9/06 2/105

(Continued)

FOREIGN PATENT DOCUMENTS

JP H03280904 A 12/1991
JP 2011-024982 A 2/2011
KR 2012-0014989 A 2/2012

(Continued)

OTHER PUBLICATIONS

International Search Report and Written Opinion of the International Searching Authority dated May 28, 2015 of PCT/US2015/011492.

*Primary Examiner* — Gloria Hale
(74) *Attorney, Agent, or Firm* — Pearne & Gordon LLP

(57) ABSTRACT

A brassiere and a decorative element having a relatively flat configuration, a set of suspension straps symmetrically arranged about a vertical plane between the brassiere cups serving to locate the decorative element symmetrically about the vertical plane above, and free of contact with a bridge between the cups, the suspension straps on each side of the decorative element including a first suspension strap attached to a mid-section of an associated cup and to an adjacent side edge of the decorative element and a second suspension strap spaced above the first suspension strap and attached to the adjacent side edge of the decorative element, the first and second suspension straps being arranged to maintain a face of the decorative element facing in a direction to which the cups project.

9 Claims, 8 Drawing Sheets

(56) References Cited

U.S. PATENT DOCUMENTS

| | | | | |
|---|---|---|---|---|
| 8,096,851 | B2 * | 1/2012 | Fine | A41C 3/08 2/104 |
| 8,152,591 | B2 * | 4/2012 | De Sousa | A41C 3/08 2/105 |
| 8,257,139 | B2 * | 9/2012 | De Sousa | A41C 3/08 2/46 |
| 8,425,274 | B1 | 4/2013 | Ratcliff | |
| 2004/0007018 | A1 | 1/2004 | Detsis | |
| 2009/0126163 | A1 * | 5/2009 | Groner | A41C 3/0028 24/302 |
| 2009/0215360 | A1 * | 8/2009 | Brideson | A41F 15/02 450/86 |
| 2010/0154472 | A1 | 6/2010 | Unitan | |
| 2010/0223713 | A1 | 9/2010 | De Sousa et al. | |

FOREIGN PATENT DOCUMENTS

| | | | |
|---|---|---|---|
| WO | 2004/047584 | A1 | 6/2004 |

* cited by examiner

BRASSIERE ACCESSORY

This application is a continuation-in-part of application Ser. No. 14/166,026, filed Jan. 28, 2014.

BACKGROUND OF THE INVENTION

The invention relates to ladies adornments and, more particularly, to a decorative element associated with a brassiere.

PRIOR ART

It is known, for example, from U.S. Pat. No. 8,425,274 and U.S. Patent Application Publication 2010/0154472 to associate a decorative element with a brassiere. Typically such elements are disposed at or form the bridge between the cups of the brassiere. As a result, the decorative element is not ordinarily displayed and, if revealed, it is not presented in a manner that obtains a prominence separate from the brassiere itself. While a necklace or chain provides a more noticeable display of a decorative element such as a pendant, any physical activity of the wearer can cause the pendant to swing and fall out of a blouse and become a distraction and/or become overturned.

SUMMARY OF THE INVENTION

The invention integrates a pendant or other decorative element with a brassiere to add fashion and distinctiveness to both of these combined elements. The inventive arrangement has the decorative element suspended in or above the space between the cups of the brassiere. The decorative element is suspended with horizontal straps that extend sideways to attachment points on the cups and, optionally, the shoulder straps of the brassiere. The suspension straps are vertically separated to allow them to maintain the decorative element in place without the risk of swinging or face reversal.

The invention may be applied to relatively inexpensive, broad appeal product lines as well as more exclusive product lines. In the lower price category, the decorative element can be, for example, made of molded plastic, non-precious metal, base metal with silver or gold plate or fabric. In the more expensive lines, the decorative element can be made, for example, of 14K or 18K gold, or sterling silver. The decorative element can be imprinted, stamped, cast or otherwise created with an image and/or can serve as a mounting for semi-precious or precious gems.

DESCRIPTION OF THE PREFERRED EMBODIMENTS

Figure 1:
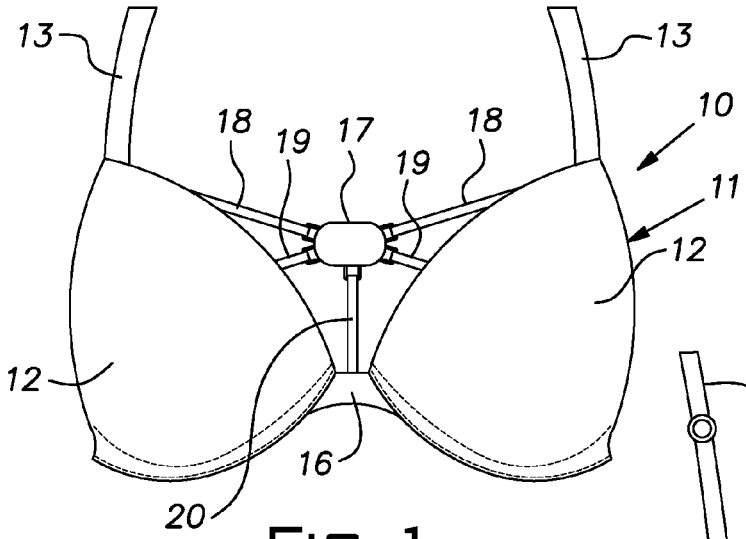
FIG. 1 is a front view of a first embodiment of a combined brassiere and decorative element.
Figure 2:
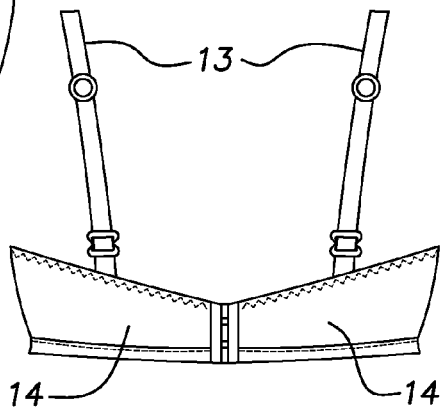
FIG. 2 is a rear view of the brassiere of FIG. 1.

Referring now to FIG. 1, there is shown a combined brassiere and decorative element 10. The brassiere or bra 11 as is typical has a pair of cups 12, shoulder straps 13 and backstraps 14, the latter being seen in FIG. 2. The cups 12 and straps 13, 14 are typically made of suitable fabric elements sewn together. Adjacent rim areas of the cups 12 are joined by a fabric band or bridge 16 sewn to each cup 12. The cups 12 project in a direction rising above the plane of the drawings of FIG. 1 and FIG. 7.

The decorative element, designated 17 and sometimes referred to simply as the element, is located so that it is symmetrical about a vertical plane centered between the cups 12 and is spaced above the bridge 16. The element or pendant 17 is kept in place by a set of fabric suspension straps or strands 18, 19 and 20 which in the showing of FIG. 1 are five in number. The straps include two lower pieces 18 and two upper pieces 19 extending inwardly from respective cups 12 and a single piece 20 extending upwardly from the bridge 16.

Figure 3:
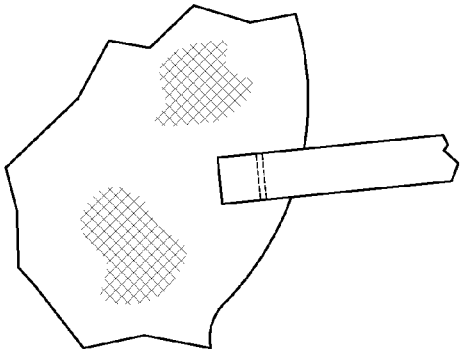
FIG. 3 is an enlarged view of one arrangement for attaching a decorative element suspension strap to the brassiere.

FIG. 3 shows a typical end of a suspension strap 18-20 distal from the element 17, fixed by sewing to respective areas of the cups 12 and bridge 16.

Figure 4:
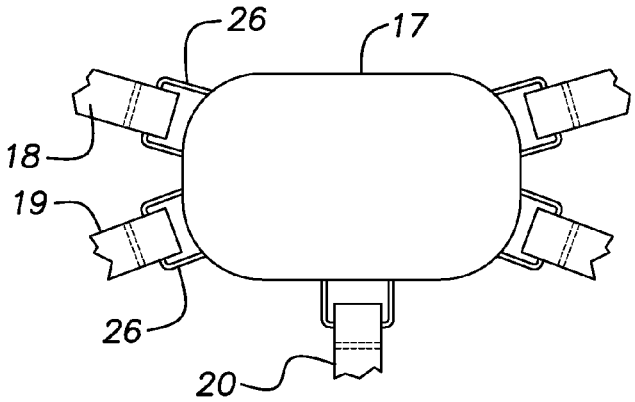
FIG. 4 is an enlarged front view of a decorative element and the attachment of the suspension straps thereto.

As seen in FIG. 4, ends of the suspension straps 18-20 adjacent the element 17 are passed through eyelets or loops 26 fixed to the element 17 at locations spaced about its periphery. Upper and lower side loops 26 extend sideways from each side edge of the element 17 and a fifth loop extends downwardly from a lower edge of the element. The support straps 18-20 are threaded through the element loops 26 and stitched down upon themselves.

The construction, as described, where the distal ends of the suspension straps 18-20 are sewn directly to the cups 12 is particularly suited for less expensive forms of the product 10.

Figure 7:
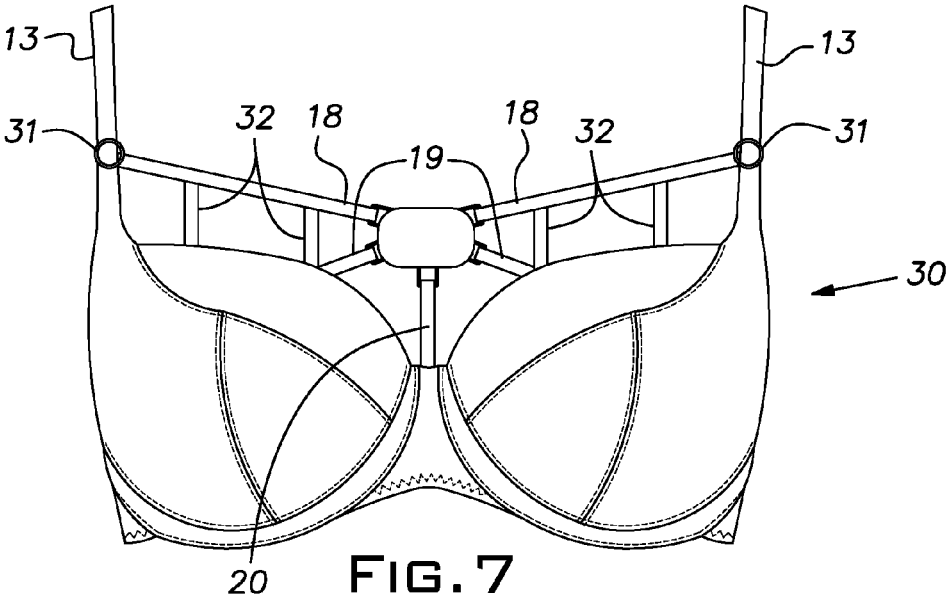
FIG. 7 is a second embodiment of a brassiere and decorative element.
Figure 8:
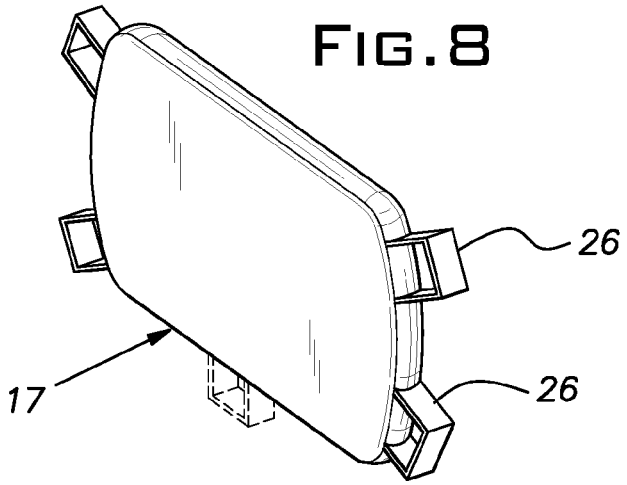
FIG. 8 is a perspective view of one form of decorative element.
Figure 11:
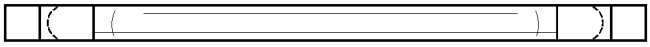
FIG. 11 is a top view of the decorative element of FIG. 8.
Figure 9:
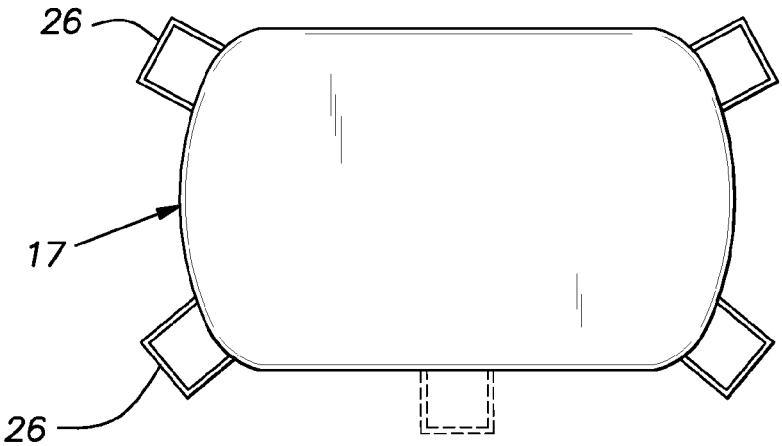
FIG. 9 is a front view of the decorative element of FIG. 8, the rear view being identical.
Figure 10:
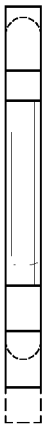
FIG. 10 is a side view of the decorative element, the opposite side being identical.
Figure 12:
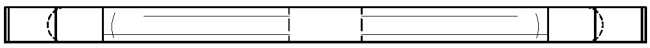
FIG. 12 is a bottom view of the decorative element of FIG. 8.
Figure 13:
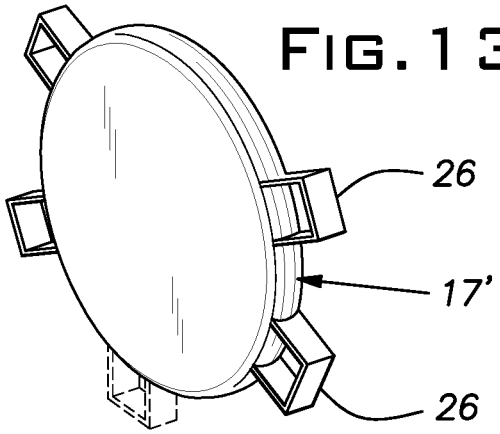
FIG. 13 is a perspective view of a second form of decorative element.
Figure 16:
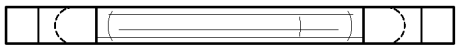
FIG. 16 is a top view of the decorative element of FIG. 13.
Figure 14:
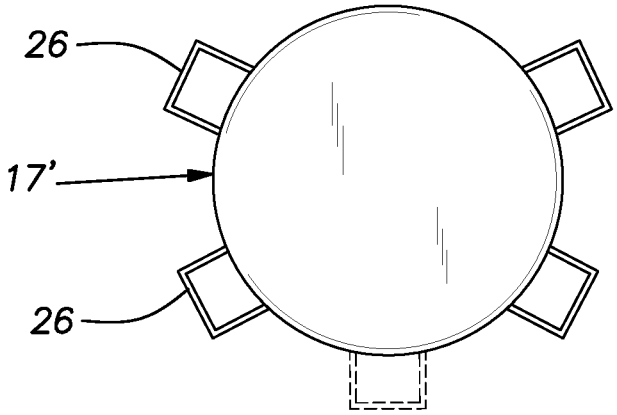
FIG. 14 is a front view of the decorative element of FIG. 13, the rear view being identical.
Figure 15:
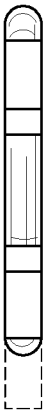
FIG. 15 is a side view of the decorative element, the opposite side being identical.
Figure 17:
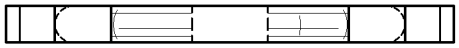
FIG. 17 is a bottom view of the decorative element of FIG. 13.

FIG. 7 illustrates a variant of the invention where a bra 30, constructed of fabric, has its upper sideways extending suspension straps 18 fixed to respective shoulder straps 13. In the illustrated case, the upper suspension straps 18 have their distal ends threaded through rings 31 of the shoulder straps 13 and stitched back down on themselves. Alternatively, where the rings 31 are not employed, the distal ends of the upper suspension straps 18 can be sewn directly to the shoulder straps 13. Auxiliary suspension straps 32 are shown extending from upper suspension straps 18 downwardly to respective cups 12; the ends of the auxiliary suspension straps 32 are stitched to an associated upper suspension strap 18 and a respective cup 12. It will be noted that the suspension straps 18-20, which normally will be ribbon-like in their cross-section, are somewhat more narrow and delicate than the shoulder straps 13.

Figure 5:
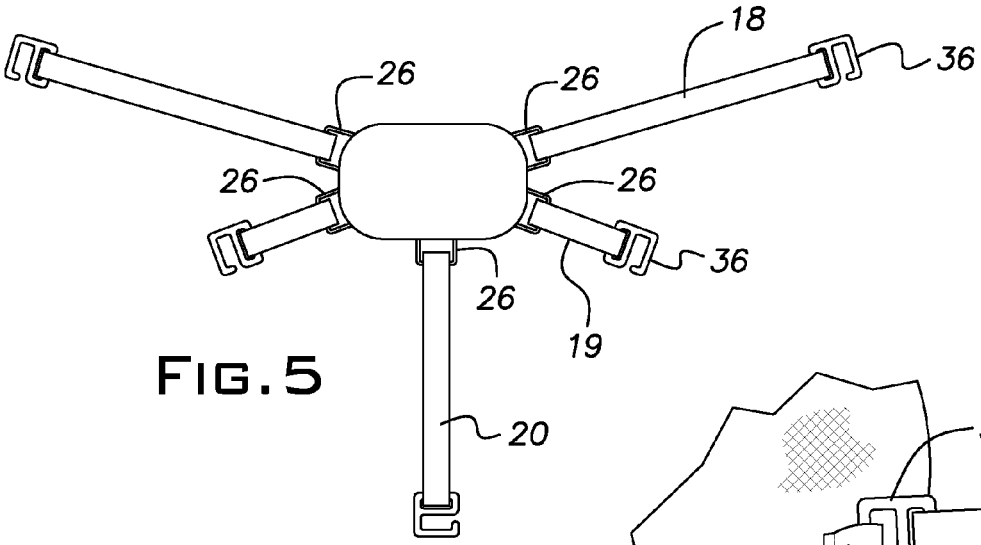
FIG. 5 is a front view of the decorative element and associated suspension straps removed from a brassiere.
Figure 6:
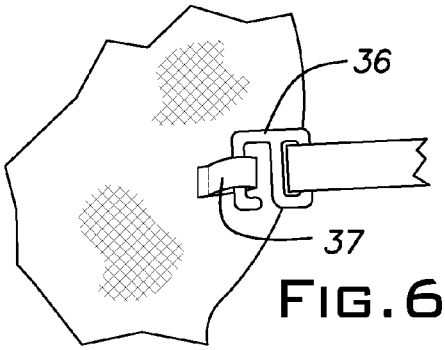
FIG. 6 is an enlarged view of a second arrangement for attaching a decorative element suspension strap to the brassiere.

Referring to FIG. 5, the distal ends of the suspension straps 18-20 can be fixed to plastic or metal hooks 36. FIG. 6 is a schematic showing of a fabric loop 37 that is sewn on a cup 12, the bridge 16 or a shoulder strap 13 at a desired location. A hook 36 is removably attached to a cup 12 or shoulder strap 13 by positioning it in the loop 37. Alternatively, a group of thread loops can be used in place of the fabric loop 37. Where the distal ends of the suspension straps 18-20 are provided with hooks 36 and the brassiere 11 with receptor loops 37, the decorative element 17 can be removed along with the suspension straps. This permits the bra 11 to be cleaned without risk that the decorative element 17 might be damaged, for example, by a cleaning detergent or that a gem or gems mounted on the element might be lost. Still further, the decorative element 17 can be fitted to another brassiere by simply reattaching the hooks 36 to the loops of the new bra 11.

FIGS. 8-12 illustrate physical details of the decorative element 17. The lower loop or eyelet 26, shown in dotted line in FIGS. 9 and 12, can be omitted along with the strap 20 for some applications. The element 17 may, for example, have a principal length, apart form the loops 26 of 2 inches and a height of 1.2 inches.

FIGS. 13-17 illustrate a variant of the decorative element 17'. The variant element 17' has four or five attachment loops 26 that have the same orientations as the loops of the element of FIGS. 8-12. The element 17' of FIGS. 13-17 can have a nominal diameter of 1.2 inches not including the loops 26.

The suspension straps 18-20 hold the element 17 above the bridge 16 so that it is visually distinguishable from the bra 11. The vertical spacing of the sideway extending straps 18-19 on each side of the element 17 prevents the element from turning inside face out.

FIGS. 18-25 illustrate exemplary two-part or two-piece pendants or decorative elements, each comprising a base and a cover. All of the illustrated bases are arranged to be supported by five straps in the manner illustrated in FIGS. 1, 4, 5, and 7. The bases have relatively flat rear faces such that they do not depart from a plane by more than ¼ inch. Most of the illustrated two-part pendants have loops 26 on their respective bases for connecting with the straps as previously described.

Typically, a cover can be mounted on and dismounted from a respective base by a purchaser of a brassiere and two-piece pendant combination. While FIGS. 18-25 illustrate circular pendants, it will be understood that a limitless variety of shapes can be employed and, in particular, the dog tag shape illustrated in FIGS. 1, 4, 5, 7, 9. Ordinarily, the cover will display or comprise a logo, symbol, or other visual mark designating, for example, a school, sorority, team, club, business or the like. While the illustrated covers have the same or similar shape as a respective base, it will be understood that a cover shape can differ from that of a base.

Figure 18:
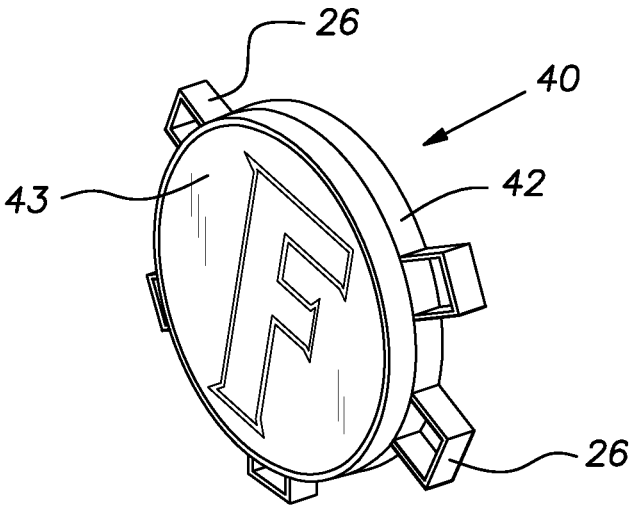
FIG. 18 is a perspective view of a two-piece decorative element or pendant.
Figure 19:
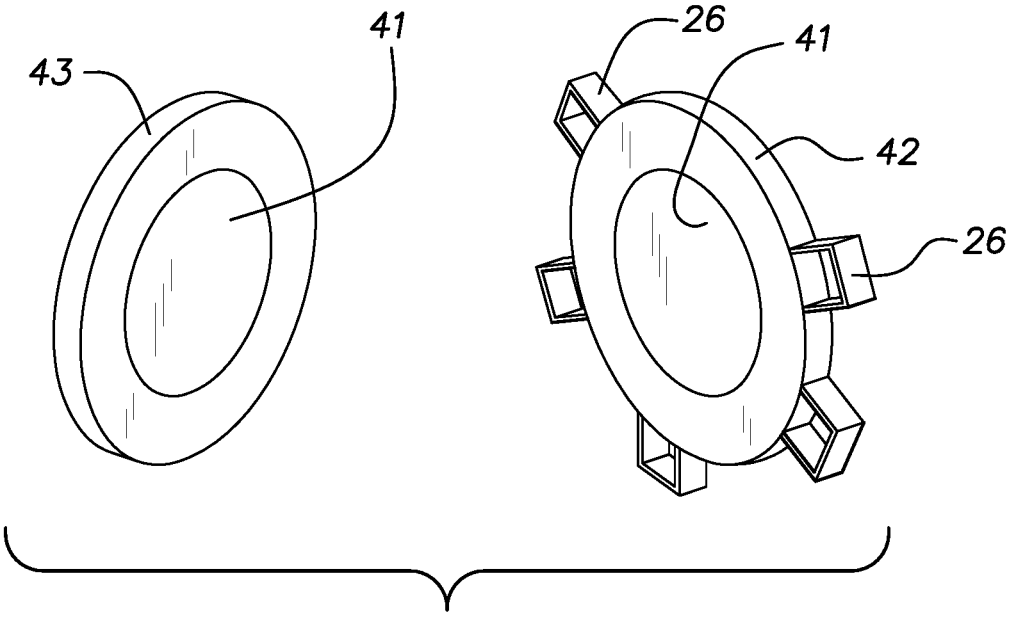
FIG. 19 is a perspective exploded view of the pendant of FIG. 18.

FIGS. 18 and 19 illustrate a pendant 40 having a rare earth permanent disc magnet 41 in each of a base 42 and a cover 43. The illustrated base 42 and cover 43 are cast of pot metal (non-ferrous metal) and include a central pocket for receiving a respective magnet 41 substantially within the front and rear planes of these base and cover elements. The magnets 41 can be adhesively, frictionally or mechanically retained in the base and cover. Where one of the base or cover is ferrous, only one magnet need be used in or on the other element. In the embodiment of FIGS. 18 and 19 as well as other below described embodiments, the numeral 26 denotes a loop for receiving a respective one of the previously described suspension straps 18-20. Where, as in FIGS. 18 and 19 the base is cast, the loops 26 can be integrally cast with the main body of the base.

The magnets 41 are preferably magnetized with their circular faces being at opposite poles and are mounted so that the cover 43 and base 42 are attracted to one another when the decorative face of the cover is directed away from the base. The base 42 and cover 43 can be cast of pot metal with technologies used in the manufacture of costume jewelry. A logo or other image can be cast, printed, molded or otherwise provided on the outer surface or decorative face of the cover 43.

Figure 20:
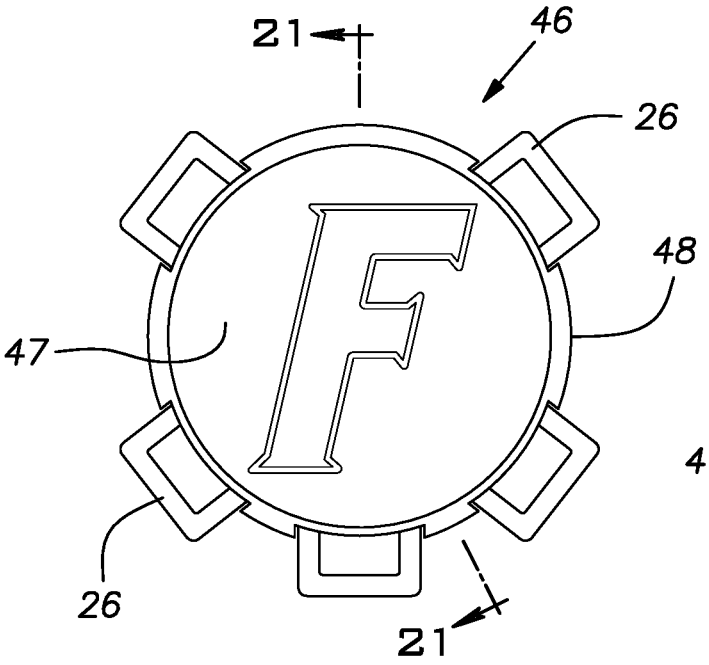
FIG. 20 is an elevational frontal view of another form of two-piece pendant.
Figure 21:
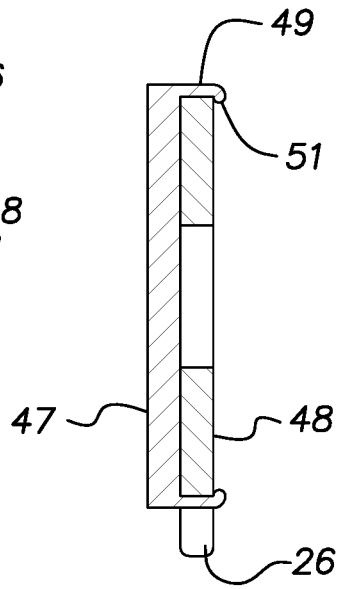
FIG. 21 is a cross-sectional view of the pendant of FIG. 20 taken in the plane indicated by the broken line 21-21 in FIG. 20.

FIGS. 20 and 21 illustrate a pendant assembly 46 in which a cover 47 and base 48 snap together. In this arrangement, the base 48 serves as a male part and the cover 47 serves as a female part. The cover 47 has a peripheral flange 49, segmented to accommodate the loops 26, that has an inside dimension at its distal edge 51 smaller than the major diameter of the base 48. The distal flange edge 51 is resiliently expanded as it is forced against the base 48 until it snaps over the major diameter of the base and springs back towards its free state thereby releasably retaining the cover 47 on the base 48. The cover 47 can be removed using a flat tool and the loops 26 as a fulcrum to pry the flange or lip 49 off the base 48.

Figure 22:
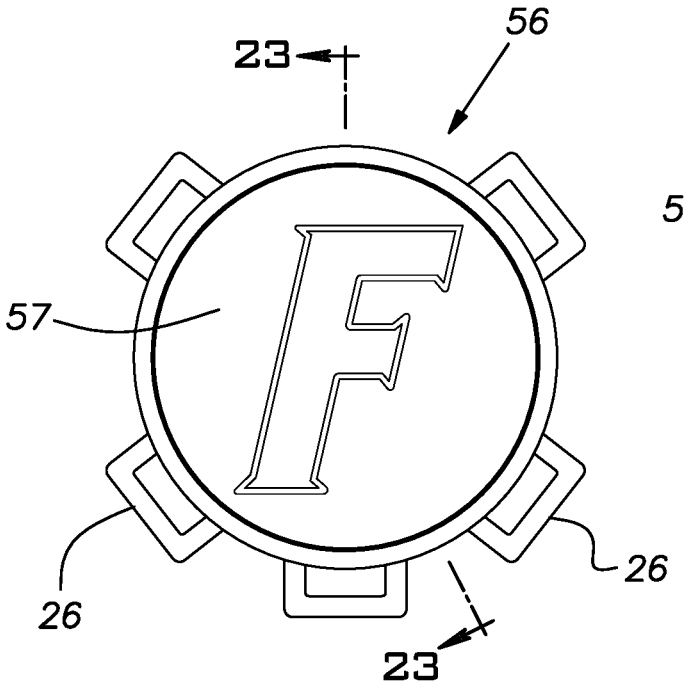
FIG. 22 is an elevational frontal view of another form of two-piece pendant.
Figure 23:
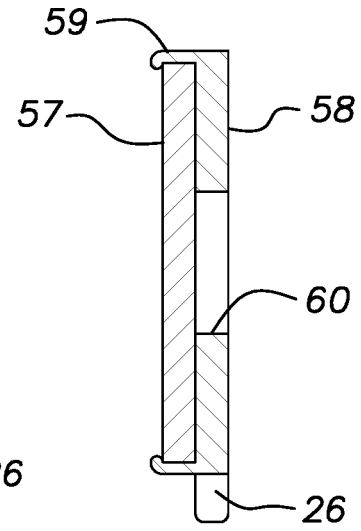
FIG. 23 is a cross-sectional view of the pendant of FIG. 22 taken in the plane indicated by the broken line 23-23 in FIG. 22.

FIGS. 22 and 23 illustrate a pendant assembly 56 where a cover 57 snaps into a base 58. The base 58 has a peripheral flange 59 that has an inside dimension adjacent its distal edge which is slightly smaller than the major diameter of the cover 57. When the cover 57 is pressed against the base 58, the flange or lip 59 expands until the part of the flange having a minimum diameter passes over the maximum diameter of the cover 57 and the flange snaps back towards its free state at which condition the cover 57 is releasably retained on the base 58. A central hole 60 can be provided in the base 58 to receive a tool to push the cover 57 off the base.

Figure 24:
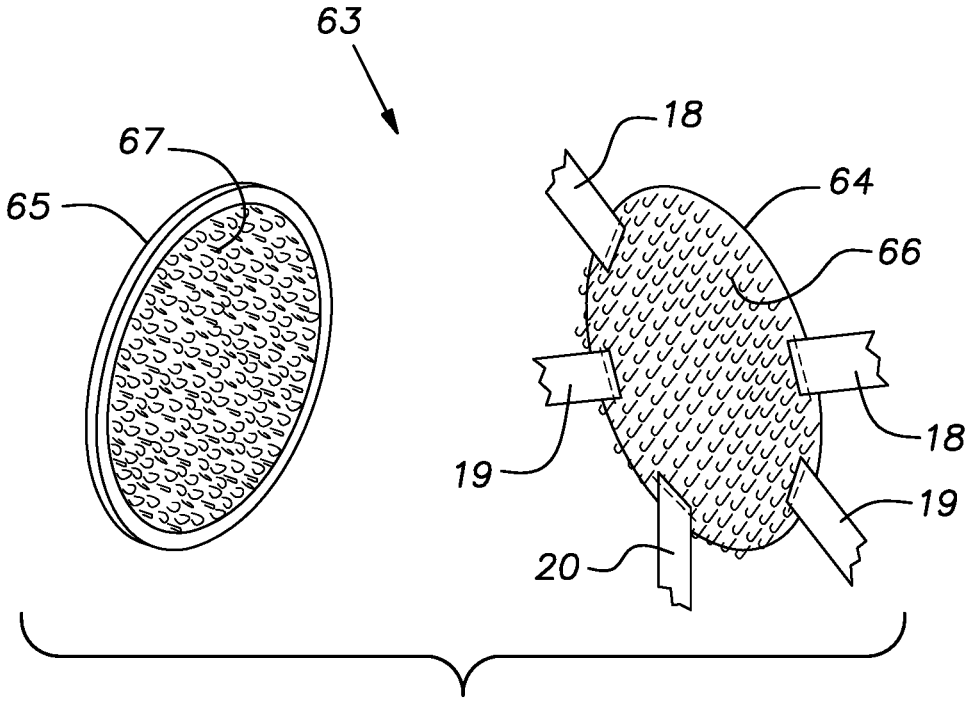
FIG. 24 is an exploded perspective view of still another two-piece pendant.

FIG. 24 illustrates a pendant 63 having a base 64 and a cover 65 assembled with hook and loop style fasteners. In the illustrated arrangement, the hook style fastener 66 is provided on the base 64 and the loop style fastener 67 is provided on the cover 65. The positions of the hook and loops can be reversed on the base and cover. Where the base 64 is a suitable plastic such as is commercially available with conventional hook and loop products, the suspension straps 18-20 can be sewn directly on the base 64 as is suggested in FIG. 24.

Figure 25:
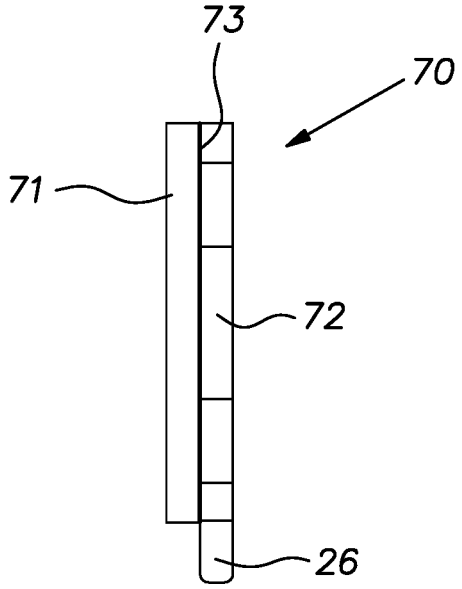
FIG. 25 is a side view of another form of pendant.

FIG. 25 illustrates a pendant 70 where a cover 71 and base 72 are releasably joined by an adhesive 73. The adhesive can be a pressure sensitive adhesive and be originally applied to either the cover 71 or base 72 and can be provided with a release paper or film which is removed at the time of applying the cover to the base.

The two-piece pendants enable a manufacturer to assemble a brassiere with a specific type of base and at the time of purchase, a customer can select a cover compatible with the specific base and with a desired logo or other image.

Figure 26:
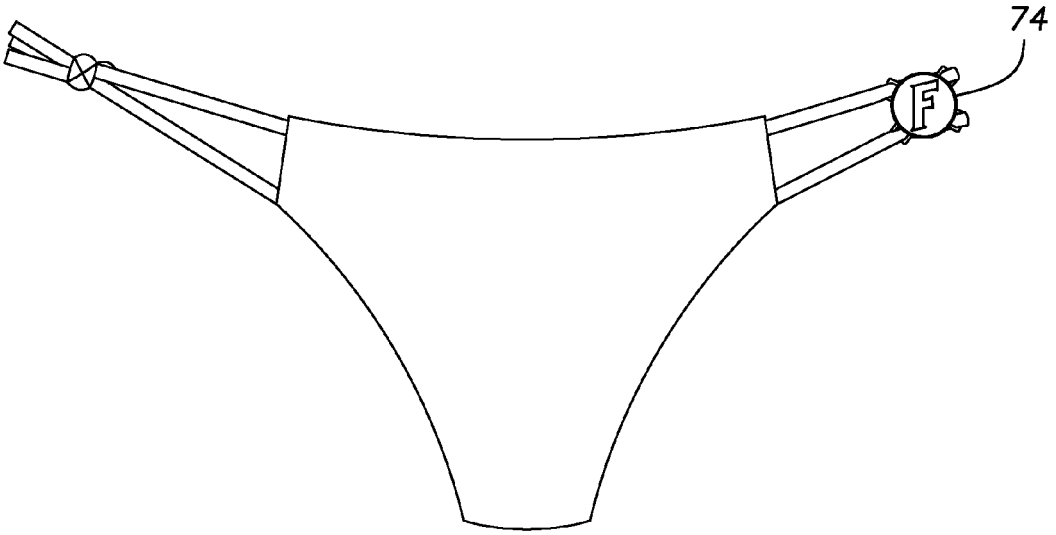
FIG. 26 is a front view of a bikini bottom in which a pendant is employed.
Figure 27:
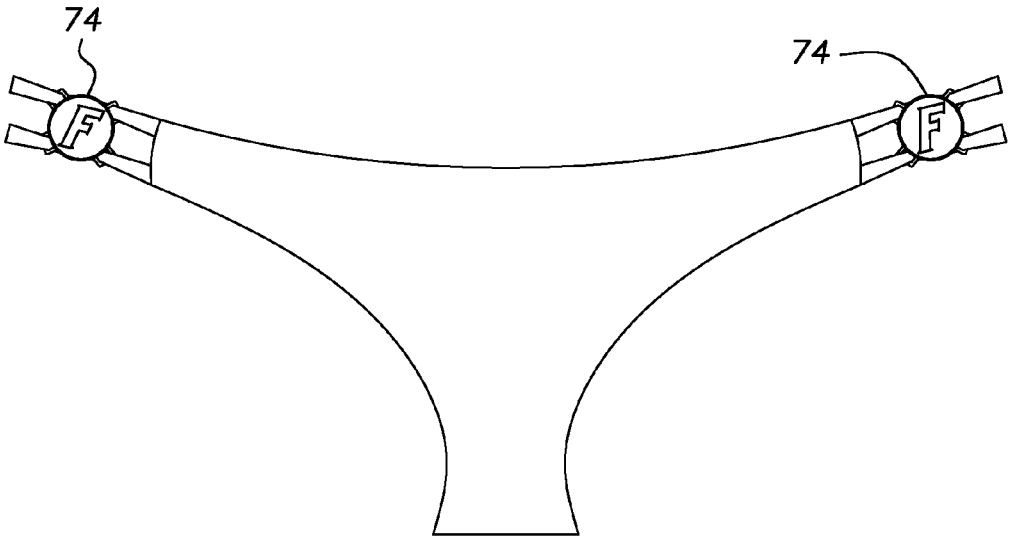
FIG. 27 is a front view of a bikini bottom in which two pendants are employed.

FIGS. 26 and 27 show examples of a bikini bottom in which one or two pendants or decorative elements 74 can be employed. The decorative elements 74 can be of a construction essentially the same as any of the foregoing descriptions with the difference being that only one or two loops 26 on each side of the decorative element need be employed and the fifth loop may be omitted. The face of the decorative element can have the same design, such as a logo, as used with a selected brassiere.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In combination, a brassiere and a decorative element, the brassiere having a pair of adjacent cups symmetrically disposed about a vertical plane, the cups each being supported by an associated shoulder strap and being mutually coupled by an intermediate bridge at the vertical plane, a set of suspension straps symmetrically arranged about said vertical plane serving to locate the decorative element symmetrically about the vertical plane above the bridge and free of contact with the bridge, the set of suspension straps having on each right and left side of the brassiere a suspension strap attached to a mid-section of a cup and to an adjacent side edge of the decorative element and another suspension strap spaced above the cup attached suspension strap attached to the decorative element substantially above a mid-height of the decorative element and inclined upwardly in a generally straight line, and an additional central bridge attaching suspension strap extending vertically from said bridge to said decorative element and attached therebetween to both said bridge and said decorative element, the decorative element having a base to which said suspension straps are attached and a cover releasably attached to the base, the cup attached and the another suspension straps being arranged to maintain a face of the cover attached to the base facing in a direction to which said cups project.

2. The combination as set forth in claim 1, wherein the cover is retained on the base with a permanent magnet.

3. The combination as set forth in claim 2, wherein the cover and base each include a permanent magnet.

4. The combination as set forth in claim 2, wherein said permanent magnet is a disc with faces having opposite polarity.

5. The combination as set forth in claim 1, wherein said cover and base are constructed and arranged to releasably snap together.

6. The combination as set forth in claim 1, wherein said cover is releasably adhered to the base.

7. The combination as set forth in claim 1, wherein said cover is releasably attached to said base with hook and loop fasteners.

8. In combination, a brassiere and a decorative element, the brassiere having a pair of adjacent cups symmetrically disposed about a vertical plane, the cups each being supported by an associated shoulder strap and being mutually coupled by an intermediate bridge at the vertical plane, a set of suspension straps symmetrically arranged about said vertical plane serving to locate the decorative element symmetrically about the vertical plane above the bridge and free of contact with the bridge, the set of suspension straps having on each right and left side of the brassiere a suspension strap attached to the decorative element substantially above a mid-height of the decorative element and inclined upwardly in a generally straight line, and an additional central bridge attaching suspension strap extending vertically from said bridge to said decorative element and attached therebetween to both said bridge and said decorative element, the decorative element having a base to which said suspension straps are attached and a cover releasably attached to the base, the suspension straps being constructed and arranged to maintain a face of the cover attached to the base facing in a direction to which said cups project.

9. The combination as set forth in claim 8, wherein a rear face of the base is relatively flat.

* * * * *